US007164963B2

(12) United States Patent
Caulk

(10) Patent No.: US 7,164,963 B2
(45) Date of Patent: Jan. 16, 2007

(54) SYSTEM, METHOD AND APPARATUS FOR LOST FOAM CASTING ANALYSIS

(75) Inventor: David A. Caulk, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 28 days.

(21) Appl. No.: 11/158,279

(22) Filed: Jun. 21, 2005

(65) Prior Publication Data

US 2006/0000576 A1 Jan. 5, 2006

Related U.S. Application Data

(60) Provisional application No. 60/584,074, filed on Jun. 30, 2004.

(51) Int. Cl.
*G06F 19/00* (2006.01)
*B22C 9/04* (2006.01)

(52) U.S. Cl. ..... 700/146; 436/55; 164/4.1; 164/34; 164/457

(58) Field of Classification Search ..... 700/145–147, 700/182; 164/4.1, 34, 457; 436/55
See application file for complete search history.

(56) References Cited

U.S. PATENT DOCUMENTS 5,062,470 A * 11/1991 Rikker ..... 164/457
5,731,982 A * 3/1998 Namba et al. ..... 700/182
2006/0000577 A1* 1/2006 Caulk ..... 164/457

OTHER PUBLICATIONS

Gurdogan, O., et al., Mold-Filling Analysis for Ductile Iron Lost Foam Castings, AFS Transactions, vol. 104, pp. 451-459, 1996.
Hirt, C.W., and Barkhudarov, M. R., "Lost Foam Casting Simulation with Defect Detection," in Modeling of Welding, Casting and Advanced Solidification Processes VIII, Ed. by B. G. Thomas and C. Beckerman, TMS, Warrendale, 1998.
Houzeaux, G. and Codina, R., "A finite element model for the simulation of lost foam casting," Int. J. Numer. Meth. Fluids, vol. 46, pp. 203-226, 2004.
Liu, Y., et al., "Numerical modeling and experimental verification of mold filling and evolved gas pressure in lost foam casting," J. of Materials Science, vol. 37, pp. 2997-3003, 2002.

(Continued)

*Primary Examiner*—Leo Picard
*Assistant Examiner*—Douglas S. Lee
(74) *Attorney, Agent, or Firm*—Kathryn A. Marra

(57) ABSTRACT

Disclosed are a method, system and apparatus for analyzing foam decomposition in gap mode during mold filling in lost foam casting, the casting process in gap mode characterized by a bubble flux and the mold filling having a mold filling speed. The method includes providing a plurality of values for casting process parameters as variables in a plurality of predetermined equations, simultaneously solving the plurality of predetermined equations including the parameter values, calculating a flux value for the bubble flux, a gap value for the gap width, and a speed value for the mold filling speed, and determining whether to adjust at least one of the parameter values based on at least one result for the bubble flux, mold filling speed, or gap width.

20 Claims, 4 Drawing Sheets

OTHER PUBLICATIONS

Shivkumar, S., "Modeling of temperature losses in liquid metal during casting formation in expendable pattern casting process," Materials Science and Technology, vol. 10, pp. 986-992, 1994.

Tsai, H. L., and Chen, T. S., "Modeling of Evaporative Pattern Process, Part I: Metal Flow and Heat Transfer During the Filling Stage ," AFS Transactions, vol. 96, pp. 881-890, 1988.

Wang, C. M., et al., "Computational Fluid Flow and Heat Transfer During the EPC Process," AFS Transactions, vol. 101, pp. 897-904, 1993.

* cited by examiner

SYSTEM, METHOD AND APPARATUS FOR LOST FOAM CASTING ANALYSIS

CROSS REFERENCE TO RELATED APPLICATION

This application claims priority to U.S. Provisional Application Ser. No. 60/584,074, titled, "LOST FOAM CASTING ANALYSIS METHOD," filed Jun. 30, 2004, which is incorporated by reference herein in its entirety.

TECHNICAL FIELD

Described are a system, method and apparatus that pertain to lost foam casting of metal alloys. More particularly, the system, method and apparatus pertain to evaluation, analysis, and manipulation of lost foam casting process parameters for production of products by a lost foam casting process.

BACKGROUND OF THE INVENTION

Lost foam casting (also called evaporative pattern casting and expendable pattern casting) evolved from the full mold process following the general availability of expanded polystyrene foam. In full mold casting, a bonded sand mold is formed around a foam pattern cut to the size and shape of the desired casting. Liquid metal is poured directly into the pattern, causing the foam to melt and then vaporize under the heat of the metal. Air and polymer vapor escape from the mold cavity through narrow vents molded into the sand above the pattern, allowing the liquid metal to displace the entire volume originally occupied by the foam. The full mold process is particularly useful for making large, one-off castings such as metal stamping dies.

The main difference between lost foam casting and the full mold process is that in lost foam casting the mold is made from loose sand, which is consolidated around the pattern by vibration. Vents are not required because the foam decomposition products are able to escape through the natural interstices between the sand grains. Patterns are molded to shape rather than cut from a larger foam block, and sometimes they are glued together from two or more pieces when internal passages do not allow them to be molded as one. After the pattern is assembled, it is dipped in a water-based refractory slurry and allowed to dry. This forms a porous coating on the surface of the pattern, which keeps the metal from penetrating the sand while still allowing the foam decomposition products to escape from the mold cavity. The coated pattern is then placed inside a steel flask and surrounded with loose, dry sand. Next, the flask is vibrated to consolidate the sand and encourage it to fill any open passages in the pattern. After that, liquid metal is poured into the pattern, which gradually gives way to the hot metal as its gas and liquid decomposition products diffuse through the coating and into the sand. Once the casting solidifies, the sand is poured out of the flask and the casting is quenched in water.

In the past few years, some lost foam foundries have begun using synthetic ceramic media in place of silica sand primarily because of its superior durability and its more insulative thermal properties. Here, the term sand is used in a generic sense to refer to any type of granular mold media.

As a process for making complex parts in high volume, lost foam casting has several important advantages. First, the molds for the foam patterns are relatively inexpensive and easy to make. Castings are free from parting lines, and draft angles can be reduced or even eliminated. Internal passages may be cast without cores, and many design features, such as pump housings and oil holes, can be cast directly into the part. Lost foam casting is more environmentally sound than traditional green sand casting because the sand can be cleaned and reused.

Unlike traditional casting processes (such as lost wax casting) where metal is poured directly into an empty mold cavity, the mold filling process in lost foam casting is controlled more by the mechanics of pattern decomposition than by the dynamics of metal flow. The metal advances through the pattern only as fast as foam decomposes ahead of it and the products of that decomposition are able to move out of the way. Before any liquid metal can flow into the cavity, it must decompose the foam pattern immediately ahead of it. As it does, some of the foam decomposition products can mix with the metal stream and create anomalies such as folds, blisters, and porosity in the final casting.

Lost foam casting has been used successfully with aluminum, iron, bronze, and more recently magnesium alloys. In the auto industry, for example, aluminum is used to make engine blocks and heads. Currently, more experimental data is available for aluminum than for any other material.

In spite of its many advantages, lost foam casting is still prone to fill-related process anomalies due to foam decomposition products that are unable to escape from the mold cavity before the casting solidifies. These anomalies are divided into four main categories. Gas porosity is created when foam decomposition products remain trapped inside the metal as it solidifies. Blisters form on the upper surfaces of castings when rising bubbles are trapped below a thin surface layer of solidified metal. Wrinkles form on casting surfaces when residual polymer liquid is caught between the metal and the coating and cannot escape before the casting solidifies. Sometimes, though, even when all the foam decomposition products do escape from the mold cavity, they still leave folds in the casting. A fold is a pair of unfused metal surfaces, usually contaminated by oxides and carbon residue, left behind when a pocket of polymer liquid or gas collapses on itself.

SUMMARY

Disclosed herein are a method, system, and apparatus for analyzing foam decomposition in gap mode during mold filling in lost foam casting. Gap mode is explained below. The method includes providing a number of values for casting process parameters as variables in a set of predetermined equations. The method also includes simultaneously solving the set of predetermined equations that include the parameter values. The method further includes calculating a flux value for the bubble flux, a gap value for the gap width, and a speed value for the mold filling speed, and determining whether to adjust at least one of the parameter values based on an analysis of the flux value, the gap value, and the speed value.

Gap mode is a distinct mode of foam decomposition in lost foam casting. Gap mode occurs during mold filling in lost foam casting when residual polymer liquid created as foam decomposes along one flow front is overtaken and vaporized by the advancing liquid metal. The vapor rises in small bubbles within the liquid metal until it reaches a second flow front higher up in the mold cavity, where it accumulates to form a finite gap between the liquid metal and the decomposing foam.

When the vapor meets the second flow front, foam decomposition along the second flow front changes from contact mode (where the liquid metal makes direct contact with the foam, decomposing it by ablation) to gap mode. Heat conduction from the metal to the foam is reduced because of the widening gap, radiation suddenly becomes important, and the foam begins to recede by melting rather than by ablation. The surface of the liquid metal below the gap levels out and its upward motion depends on a balance among the vapor bubbling into the gap from below, the air released by the foam melting above it, and the gas that is able to escape through the exposed coating in between.

Unlike other modes, foam decomposition in gap mode is non-local. It is affected not just by conditions along the immediate flow front, but also by what happens to residual liquid left behind by foam decomposing in other parts of the cavity. Two different physical processes control foam decomposition in gap mode: (1) polymer vapor bubbling up through the liquid metal and (2) heat and mass transfer across the gap.

DETAILED DESCRIPTION

Figure 1:
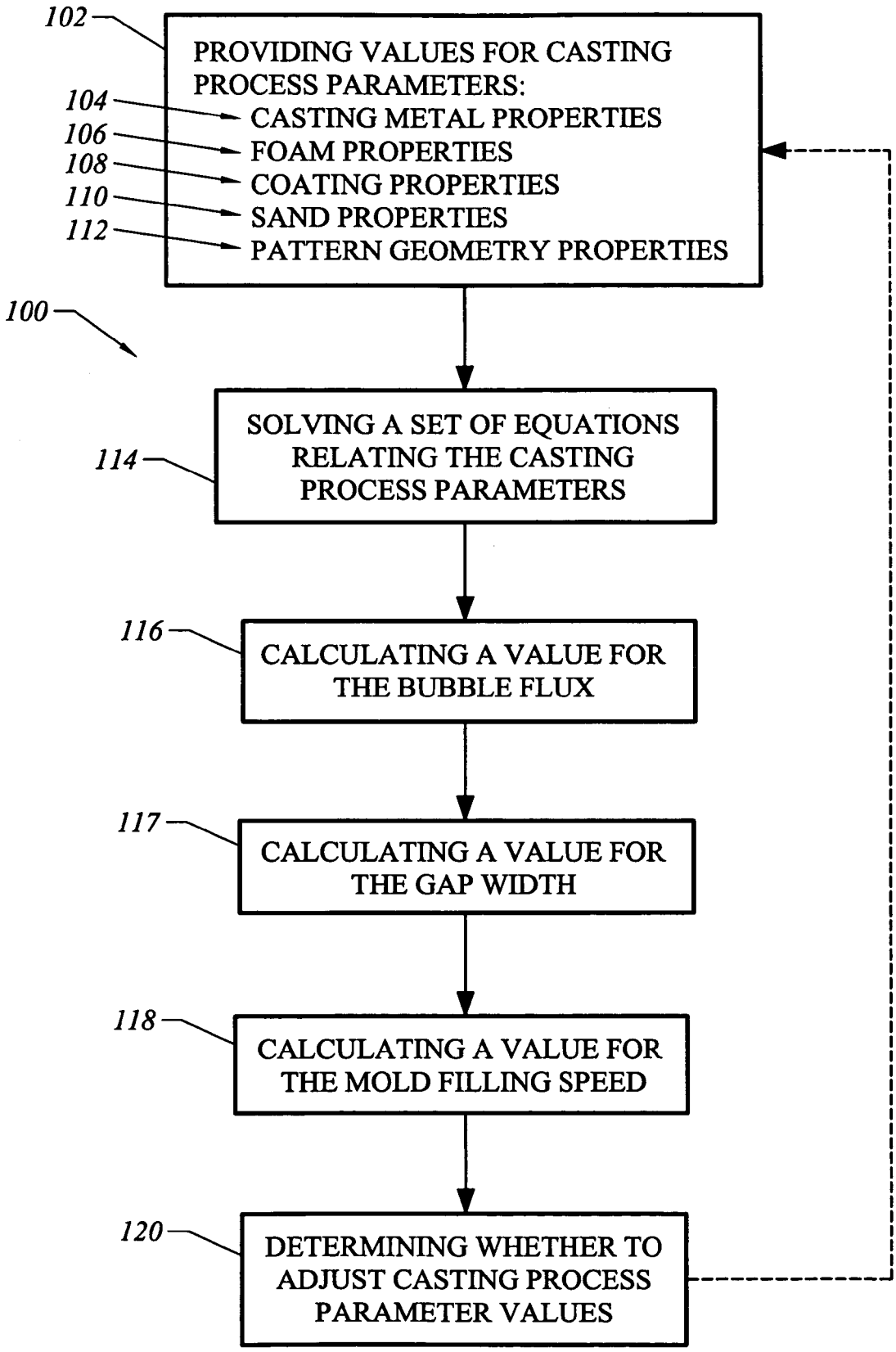
FIG. 1 shows a flowchart for performing an embodiment of the mathematical algorithms as described herein

Disclosed herein are a system, method and apparatus for analyzing foam decomposition in gap mode during mold filling in lost foam casting. In general, when foam is heated by liquid metal during the casting process, it decomposes into liquid and gas byproducts. Different process conditions lead to different mechanisms of foam decomposition, called modes. Gap mode is described herein. Regardless of the decomposition mode, though, some part of the foam material always decomposes to liquid. Depending on the local process conditions, the coating may absorb some of this residual liquid, while the remainder, called the excess liquid, begins to vaporize as soon as it comes in contact with the advancing liquid metal.

In most cases, the excess polymer liquid vaporizes slowly, breaking free in small bubbles, which then rise due to their natural buoyancy in the much denser liquid metal. When the rising bubbles reach another flow front, gas begins to accumulate until a gap opens up between the liquid metal and the unmelted foam. This changes the mechanism of subsequent foam decomposition along that front from contact mode to gap mode. The separation between the liquid metal and the unmelted foam is not only much wider than it was in contact mode, but it is sustained by gas coming from remote locations in the cavity. The non-local aspect of gap mode makes it unique among the different modes of foam decomposition in lost foam casting. Analysis of gap mode includes both foam decomposition along the immediate flow front as well as vaporization of excess polymer liquid and buoyant movement of polymer vapor bubbles through the liquid metal.

Foam decomposition in gap mode may be characterized by a gap width $l_G$ and a bubble flux m, the latter representing the local mass flux of polymer vapor entering the gap from below. The casting process may also be characterized by a mold filling speed u, that is, the rate at which the surface of the liquid metal is advancing in the mold. Each of the bubble flux, the gap width, and the mold filling speed may have predetermined ranges as known to those skilled in the art.

As discussed further below, the method and system include providing values for casting process parameters as variables in a set of equations so that the below-described algorithm may provide boundary conditions on metal flow during a lost foam casting process, and may provide analysis that generates information used to improve the casting process. The casting process parameters may include properties of a casting metal, properties of the foam material, properties of a coating material for coating the foam, properties of a sand or ceramic material surrounding the coated foam, and parameters characterizing the foam pattern geometry. The method and system also include solving a set of equations relating the thermal and other physical properties of the casting metal, the foam material, the coating and sand, and one or more characteristics of the pattern geometry. Herein characteristics may also be referred to as properties. In solving the set of equations, the following values may be calculated: the bubble flux, speed of foam recession in the mold, the width of the gap, and the mold filling speed. Output of one or all of the bubble flux value m, the foam recession speed value $u_F$, the gap width value $l_G$, and the mold filling speed value u may be used in an analysis to determine whether to adjust at least one of the casting process parameters.

This invention may be embodied in the form of any number of computer-implemented processes and apparatuses for practicing those processes. Embodiments of the invention may be in the form of computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention may also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

FIG. 1 shows a flow chart 100 of an embodiment of the method described herein. In a step 102, values for casting process parameters are provided as variables to the set of equations as will be described below. Other variables as will be described are provided as well. Casting process parameters include casting metal properties 104, properties 106 of the foam material, properties of a foam pattern coating 108, properties 110 of the sand in which the coated foam pattern is embedded during the casting process, and pattern geometry characteristics 112. Metal used in lost foam casting may include aluminum or magnesium alloys, but other metals may be used as well.

As mentioned, several parameters are provided as variables to a set of equations. It will be understood that the set of equations may be revised from the exemplary equations that are described below to include fewer or more properties. The output from the calculations is used to adjust at least one of the casting process parameters for improved casting. For example, casting metal parameters 104 include its temperature and its pressure, the latter usually expressed in the form of the equivalent metal head. A lost foam casting process using aluminum as the casting metal may use a metal temperature between 600 and 800 degrees Celsius. The metal head may range from a few centimeters to more than a meter. The choice of these values to be inserted in the equations (see below) may depend on the size and geometry of the casting, and may also depend on other parameters associated with the casting process. Moreover, for magnesium alloys, iron alloys, or other metals, these metal parameters generally have different values. Table 1 lists representative casting metal parameters for aluminum.

TABLE 1

Casting Metal Properties for Aluminum

| Property | Symbol | Aluminum alloy |
|---|---|---|
| Temperature (C.) | $\theta_M$ | 600–800 |
| Metal head (m) | | 0.1–1.0 |
| Metal pressure (kPa) | $p_M$ | 2.5–25 |

Metal temperature $\theta_M$ and metal pressure $p_M$ may be controlled during the lost foam casting process. Additional physical properties relevant to the analysis described herein include the metal mass density $\rho_M$, the metal surface emissivity $\epsilon_M$, and a bubble diffusion coefficient $\kappa_B$. Values for these properties are listed in Table 2.

TABLE 2

Additional Physical Properties of Aluminum

| Property | Symbol | Aluminum alloy |
|---|---|---|
| Mass density (kg/m$^3$) | $\rho_M$ | 2500 |
| Surface emissivity | $\epsilon_M$ | 0.6 |
| Bubble diffusion coefficient (s/m$^2$) | $\kappa_B$ | 500 |

Another group of casting process parameters includes foam material properties 106 that may include a nominal foam density and a polymer density. Typical values for these properties are provided in Table 3 for polystyrene foam.

Another group of casting process parameters includes foam thermal properties 106 that may include a thermal conductivity, a foam material melting temperature, and values for a melting energy, degradation energy, and

TABLE 3

Foam Material Properties

| Property | Symbol | Value |
|---|---|---|
| Nominal foam density (kg/m$^3$) | $\rho_F$ | 25 |
| Polymer density (kg/m$^3$) | $\rho_S$ | 800 |

vaporization energy for the foam material. Additional foam thermal properties include specific heat values for the foam material in solid, liquid, and vapor states, the foam material vaporization rate, and the thermal conductivity of the foam material in the vapor state. Table 4 lists representative values for these properties.

TABLE 4

Foam Thermal Properties

| Property | Symbol | Value |
|---|---|---|
| Thermal conductivity (W/m-K) | $k_D$ | 0.04 |
| Melting temperature (° C.) | $\theta_P$ | 150 |
| Melting energy (J/g) | $H_M$ | 0 |
| Degradation energy (J/g) | $H_D$ | 670 |
| Vaporization energy (J/g) | $H_V$ | 360 |
| Specific heat of solid (J/g-K) | $c_S$ | 1.5 |
| Specific heat of liquid (J/g-K) | $c_L$ | 2.2 |
| Specific heat of vapor (J/g-K) | $c_V$ | 2.2 |
| Vaporization rate (kg/m$^2$-s) | $\gamma$ | 0.02 |
| Thermal conductivity of vapor (W/m-K) | $k_C$ | 0.04 |

Other physical properties of the foam material include the molecular weight and viscosity of the vapor, and the coating coverage fraction, a measure of the extent to which non-wetting liquid foam material may cover the foam pattern coating during the casting process. Typical values for these properties are listed in Table 5.

TABLE 5

Additional Foam Physical Properties

| Property | Symbol | Value |
|---|---|---|
| Molecular weight of vapor (g/mole) | $M_V$ | 104 |
| Viscosity of gas (Pa-s) | $\mu_G$ | $2 \times 10^{-5}$ |
| Coating coverage fraction | $x_C$ | 0.5 |

Other casting process parameters are material properties of the coating 108 that may include gas permeability and thickness. Properties of the sand 110 may include gas permeability and porosity. Properties characterizing the foam pattern geometry 112 may include a local pattern thickness. Typical values for properties of the coating and sand are provided in Table 6.

TABLE 6

Sand and Coating Properties

| | Property | Symbol | Value | Unit |
|---|---|---|---|---|
| Sand | Permeability | $\kappa_S$ | 100 | $\mu m^2$ |
| | Porosity | $\phi_S$ | 0.4 | |
| Coating | Permeability | $\kappa_C$ | 0.02 | $\mu m^2$ |
| | Thickness | $d_C$ | 0.2 | mm |

Figure 5:
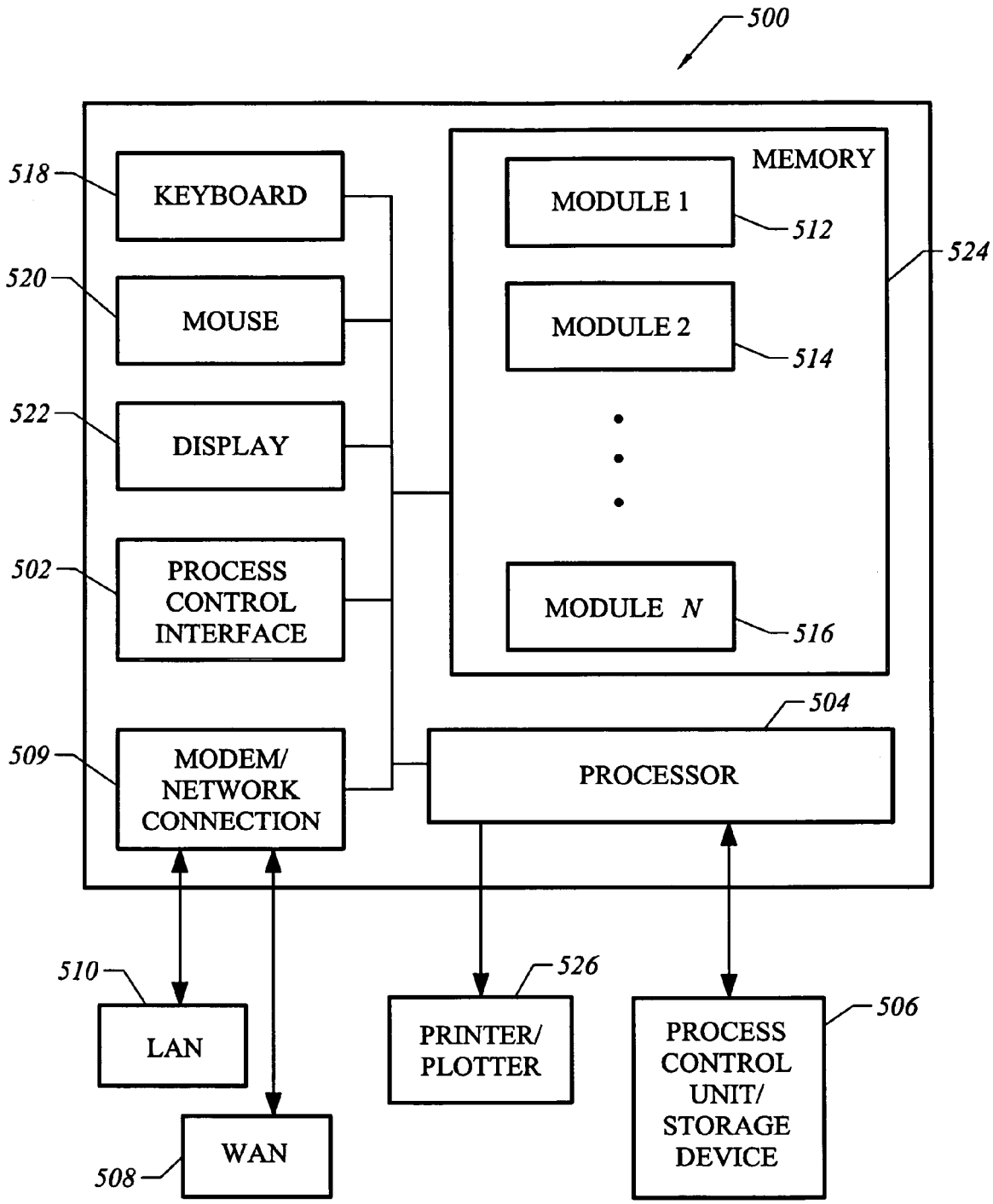
FIG. 5 shows an embodiment of a system for utilizing algorithms and software, testing the lost foam casting process, and making adjustments to the input parameters.

Casting process parameters, such as those listed in Tables 1–6, are related to other properties of the casting process, such as the bubble flux m and the mold filling speed u among other properties, through a set of equations. These equations are described in connection with FIG. 2 below. As mentioned above, solving the set of equations 114 provides a way of calculating an output value for the bubble flux 116, the gap width 117, and the mold filling speed 118. One or both of these values may be used (discussed below) in determining 120 whether to adjust casting process parameters for improved performance of a lost foam casting process. The system as shown in FIG. 5, as will be described in detail below, may rerun the above-referenced calculation with adjusted casting process parameters to generate a new bubble flux 116, a new gap width 117, and a new mold filling speed 118 as output. A determination may be made as to whether the process is improved. If it is found that the process is improved, adjustments may be made to the actual casting process, via, for example, a process control unit for active control of the actual casting system.

Figure 2:
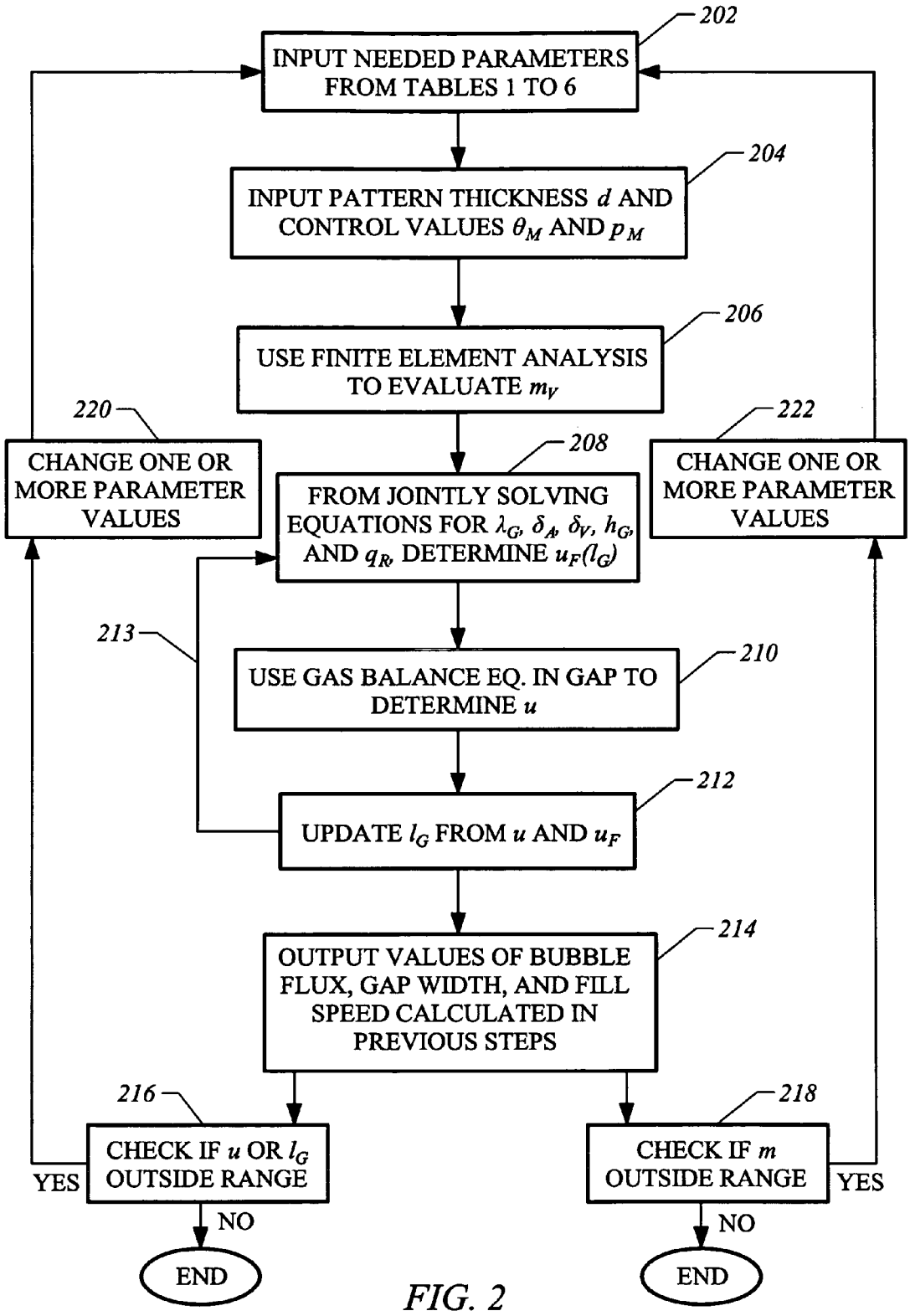
FIG. 2 depicts the algorithm for analysis of lost foam casting in gap mode, showing steps of an embodiment.

Turning now to FIG. 2, the above-mentioned set of equations relating casting process properties is described. The equations are provided with initial casting process variables and then solved simultaneously. The output includes a bubble flux (flux value), a gap width (gap value), and a mold filling speed (speed value). Depending upon the flux value, the gap value, and the speed value, the algorithm includes adjusting the casting process values and then again solving the equations simultaneously. If the process is improved as determined from the output, an active control may adjust the actual casting process.

As mentioned above, the equations include additional variables and those are described herein. In general, FIG. 2 depicts the algorithm for analysis of lost foam casting in gap mode. In general terms, FIG. 2 is a flow chart showing steps of an embodiment. Parameters specifying properties of the materials used in the lost foam casting process are designated at an input step. As discussed, these properties may include those listed in Tables 1 through 6 202. In input step 204, the input pattern thickness d, the temperature $\theta_M$ of the liquid metal, and the metal pressure $p_M$ are specified. A finite element analysis 206 may be used to evaluate the mass flux of gas entering a gap segment due to gas bubbles in the liquid metal. Numerical methods may be used to simultaneously solve a set of coupled equations 208 relating thermal properties of the metal and foam to determine the velocity $u_F$ with which the foam front recedes. A gas balance equation then may be applied in the gap to determine the metal flow front speed u at 210. The metal flow front and foam flow front speeds then may be used to update the value for the gap width, $l_G$, for the next time step 212. Steps 208 through 212 may be iterated 213 over a series of time steps. The calculated bubble flux, gap width, filling speed, and other values, may be output in a subsequent step 214. Once values for the bubble flux m, the gap width $l_G$, and liquid metal flow speed or mold filling speed u have been determined, these values are checked to see if they lie within appropriate ranges 216 and 218. If not, one or more parameter values may be changed 220 and 222 and the method re-executed.

Figure 3:
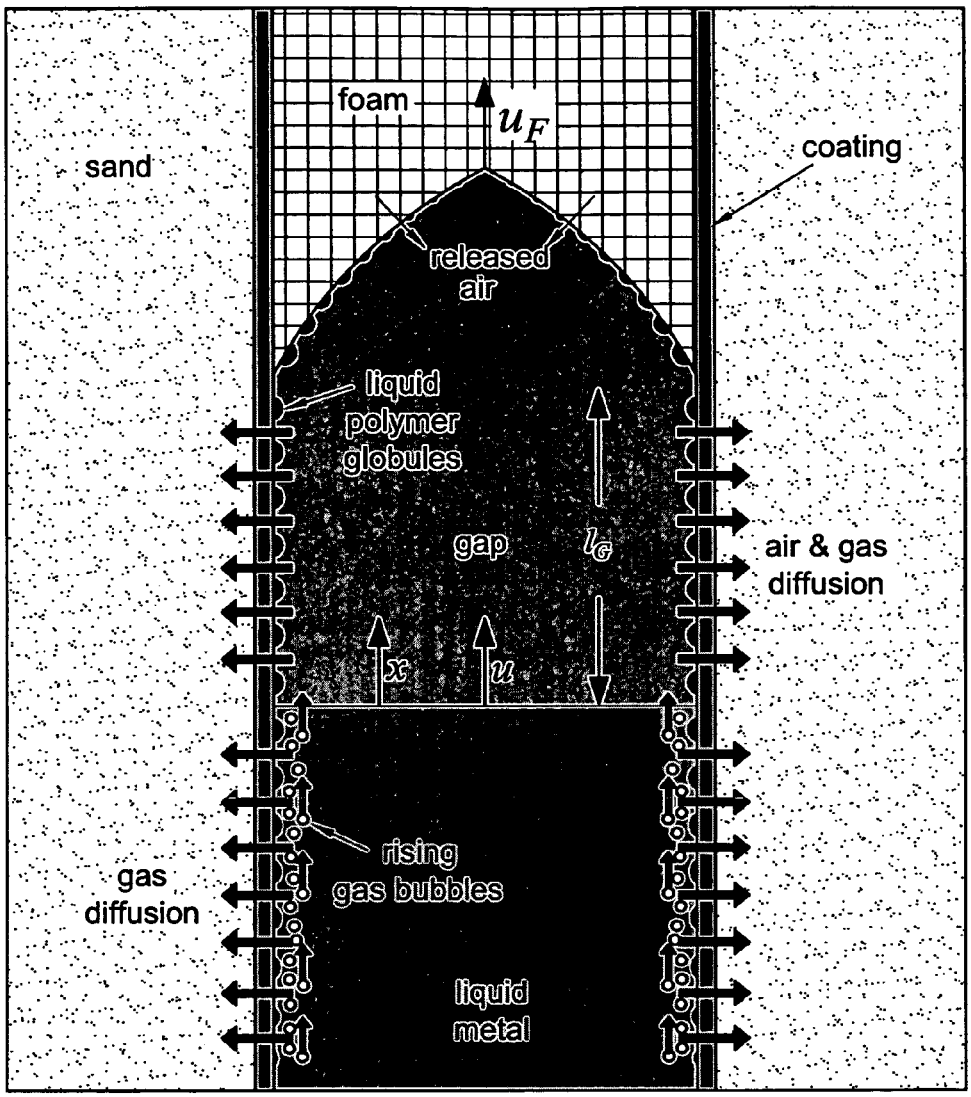
FIG. 3 depicts processes active during lost foam casting in gap mode.

In order to illustrate physical processes relevant in gap mode, FIG. 3 shows schematically a section through the pattern thickness where the foam is decomposing in gap mode. In a typical situation in which gap mode occurs, the pattern is too thick for the coating to absorb all the residual liquid formed as the pattern decomposes, leaving the rest to vaporize in small bubbles, which rise within the metal until they reach the upper flow front. There the bubbles collect to form a gap between the metal and the unmelted foam. The presence of a finite, connected gas layer along the upper flow front levels the surface of the liquid metal and slows down the upward rate of foam decomposition. Accordingly, the changing width of the gap is determined by a balance among the polymer vapor bubbling through the surface of the liquid metal from below, the air released as the foam melts from above, and the gas that is able to escape by diffusing though the exposed coating in between.

The foam pattern in FIG. 3 recedes as the heat flux from the liquid metal melts the cellular structure of the foam above it. Melting foam material gathers, due to its surface tension, into small beads or globules on the surface of the foam, and these beads are transported to the coating en masse on the receding, and increasingly oblique, surface of the foam. The foam insulates the coating from the heat of the liquid metal until just before the last of it melts away, keeping the coating relatively cool and preventing the beads of liquid polymer from wetting the inside surface of the coating when they finally get there. The polymer liquid collects in small, isolated globules on the inside surface of the coating, interspersed by regions of exposed coating through which the gas in the gap can escape into the surrounding sand. Eventually, the liquid metal overtakes the globules of liquid polymer and they too begin to vaporize, creating gas bubbles of their own. Some of the gas diffuses through the coating between the globules as it ascends. The rest reaches the surface of the liquid metal, adding to the gas already in the gap. It is assumed that none of the polymer liquid vaporizes inside the gap itself.

The variables included in the algorithm depicted in FIG. 2 are now described in greater detail, including their relationship to one another. The volume fraction of air in the foam material is denoted herein by $\phi$. It is a measurable quantity determined by the foam molding process that typically ranges between 0.96 and 0.98. With $\rho_A^0$ denoting the density of air at the initial foam pattern temperature $\theta_0$ and atmospheric pressure $p_0$, the total density of the foam pattern material $\rho_p$ is given by $$\rho_P=\phi\rho_A^0+\rho_F,$$

with the nominal foam density $\rho_F$ provided in Table 3 above. Incidentally, $\rho_F$ is related to the polymer density $\rho_S$ of Table 2 by $$\rho_F=(1-\phi)\rho_S,$$

and is the partial density of the polymer in the foam.

It is further assumed that the gas pressure in any contiguous segment of the gap is uniform and equal to the pressure $p_M$ at the surface of the liquid metal. For the relatively slow filling speeds in lost foam casting the metal pressure is quasi-static, and so the metal surface below the gap should be a level plane. The metal advances towards the foam at velocity u, and the foam recedes with velocity $u_F$. For purposes of this disclosure, let the origin of coordinates move with the surface of the liquid metal and let the x-axis be perpendicular to this surface, pointing towards the foam (see FIG. 3). All temperature gradients parallel to the surface of the metal are neglected, compared with the much steeper gradients across the width of the gap. $\theta_M$ denotes the temperature on the surface of the liquid metal and $\theta_0$ denotes the uniform pattern temperature before the casting is poured. It is assumed that on the receding foam surface, the foam reaches a nominal melting temperature designated by $\theta_P$. Unless otherwise indicated, all temperature and pressure values provided in this disclosure are taken to be absolute quantities.

The energy per unit mass $\epsilon_P$ required to heat the foam material from its initial temperature $\theta_0$ to its melting temperature $\theta_P$ is given by $$\rho_P\epsilon_P=(\phi\rho_A^0c_A+\rho_Fc_S)(\theta_P-\theta_0)+\rho_FH_M.$$

Values for quantities appearing on the right side of this equation are listed in the Tables above or readily available in standard references for physical properties. For example, the specific heat of air at 0° C. and atmospheric pressure is 1 J/g-K. Since most foam materials are amorphous polymers, the latent heat of fusion $H_M$ is usually negligible.

An assumption is made that the arched shape of the foam surface above the liquid metal may be ignored, and therefore $l_G$ is assumed to be uniform through the pattern thickness.

The changing gap width is determined by the kinematic expression $$\frac{dl_G}{dt} = u_F - u.$$

It is further assumed that as the foam melts ahead of the liquid metal all of the air it originally contains enters the gap, where it diffuses into the sand through the exposed areas of the coating between the globules of residual liquid.

Let $m_V$ denote the mass flux of polymer vapor per unit area entering the gap through the surface of the liquid metal from below and $m_A$ the corresponding mass flux of air released by the foam as it melts from above. The value of $m_V$ is determined 206 by an analysis of the vaporizing liquid behind the metal front, discussed below. The value of $m_A$ is given in terms of the foam front recession speed by $$m_A = \phi\rho_A{}^0 u_F.$$

Based on assumptions that mass fluxes $m_V$ and $m_A$ decrease linearly with distance across the gap, that heat conduction through the gap is quasi-steady, and that tangential temperature gradients may be neglected, the heat conduction equation for the gas temperature θ in the gap is given by $$k_G \frac{\partial^2 \theta}{\partial x^2} - [c_A m_A (x/l_G) - c_V m_V (1 - x/l_G)] \frac{\partial \theta}{\partial x} = 0.$$

In this equation $\kappa_G$ is the thermal conductivity of the gas mixture in the gap, and $c_A$ and $c_V$ are the specific heats of the air and polymer vapor, respectively. It is considered in this discussion that all these properties are approximately constant across the width of the gap. The boundary conditions are $$\theta(0) = \theta_M,\ \theta(l_G) = \theta_P.$$

The solution to the heat conduction equation that satisfies the two boundary conditions above is $$\theta = \theta_M - \frac{erf[\lambda_G(x/l_G - \delta_V)] + erf(\lambda_G \delta_V)}{erf(\lambda_G \delta_V) + erf(\lambda_G \delta_A)}(\theta_M - \theta_P),\ 0 \le x \le l_G,$$

with $$\lambda_G^2 = \frac{l_G}{2k_G}(c_A m_A + c_V m_V),$$

and $$\delta_A = \frac{c_A m_A}{c_A m_A + c_V m_V},\ \delta_V = 1 - \delta_A = \frac{c_V m_V}{c_A m_A + c_V m_V}.$$

The conduction heat flux corresponding to the temperature solution is $$q(x) = -k_G \frac{\partial \theta}{\partial x} = \frac{k_G}{l_G} \frac{2}{\sqrt{\pi}} \frac{\lambda_G e^{-[\lambda_G(x/l_G - \delta_V)]^2}}{erf(\lambda_G \delta_V) + erf(\lambda_G \delta_A)}(\theta_M - \theta_P),\quad 0 \le x \le l_G.$$

At the surface of the receding foam, this becomes $$q(l_G) = h_G(\theta_M - \theta_P),$$

where $$h_G = \frac{k_G}{l_G} \frac{2}{\sqrt{\pi}} \frac{\lambda_G e^{-(\lambda_G \delta_A)^2}}{erf(\lambda_G \delta_V) + erf(\lambda_G \delta_A)}.$$

represents an effective heat transfer coefficient between the liquid metal and surface of the unmelted foam.

In addition to the conduction heat flux discussed above, the foam is also subjected to radiation from the liquid metal. The average radiation heat flux $q_R$ incident on the surface of the unmelted foam is given by $$q_R = F\sigma\epsilon_M\theta_M{}^4,$$

where σ is the Stephan-Boltzman constant, $\epsilon_M$ is the emissivity of the metal surface and F is a geometric view factor between the metal surface and the foam given by $$F = \sqrt{1 + (l_G/d)^2} - l_G/d.$$

It is further assumed that all incident radiation is absorbed by the foam and any radiation emitted by the foam itself is neglected. The view factor F, and hence also the radiation heat flux $q_R$, decreases as the gap widens.

Since the combined heat flux from conduction and radiation must sustain the recession rate of the foam pattern, it follows that $$h_G(\theta_M - \theta_P) + q_R = \rho_P \epsilon_P u_F.$$

For a given value of the polymer vapor flux $m_V$, determined in step 206, and gap width $l_G$, this equation, together with equations above for $m_A$, $\Lambda_G{}^2$, $\delta_A$, $\delta_V$, $h_G$, F, and $q_R$, may be jointly solved to determine the rate of foam decomposition $u_F$ 208 at any point along a segment of the flow front in gap mode.

The heat flux $q_M$ from the metal surface is $$q_M = q(0) + \sigma\varepsilon_M\theta_M^4 = \frac{k_G}{l_G} \frac{2}{\sqrt{\pi}} \frac{\lambda_G e^{-(\lambda_G \delta_V)^2}}{erf(\lambda_G \delta_V) + erf(\lambda_G \delta_A)}(\theta_M - \theta_P) + \sigma\varepsilon_M\theta_M^4.$$

This equation provides the thermal boundary condition for the heat conduction problem in the liquid metal.

Since the surface of the liquid metal must remain horizontal along any contiguous segment of the flow front in gap mode, the metal velocity u has a single value over the entire segment. To determine this value, a mass balance for the gas mixture in the gap segment is considered 210.

Under the assumption that the average temperature and pressure in the gap are quasi-steady, an overall balance of volume for the gas in the gap is equivalent to a balance of mass. Consider a contiguous segment of the flow front where the foam is decomposing in gap mode. From the heat conduction equation for the gas temperature in the gap, the average gas temperature $\theta_G$ in the gap is $$\theta_G = \frac{1}{l_G}\int_0^{l_G} \theta(x)\,dx = \theta_P + \left[\delta_V - \frac{1}{\sqrt{\pi}\lambda_G} \frac{e^{-(\lambda_G \delta_A)^2} - e^{-(\lambda_G \delta_V)^2}}{erf(\lambda_G \delta_V) + erf(\lambda_G \delta_A)}\right](\theta_M - \theta_P).$$

Assuming the air and polymer vapor are both ideal gases, their respective densities are $$\rho_A = \rho_A^0 \frac{\theta_P}{\theta_G}, \rho_V = \frac{p_M M_V}{R\theta_G},$$

where $M_V$ is the average molecular weight of the polymer vapor bubbling up through the liquid metal and R is the universal gas constant.

It is assumed that gas diffuses through the coating according to Darcy's law, with the diffusive resistance of the sand negligible compared with that of the coating. The filter velocity $v_G$ of the gas through the open sections of the coating in the gap is given by $$v_G = \frac{\kappa_C}{\mu_G d_C} \frac{p_M^2 - p_S^2}{2p_M},$$

where $\kappa_C$ is the permeability of the coating, $d_C$ is its thickness, $\mu_G$ is the viscosity of the gas mixture, and $p_S$ is the pressure in the sand.

With $x_C$ denoting the fraction of the coating surface covered by the globules of liquid polymer, the overall balance of volume for the gas mixture in a gap segment Γ may be expressed by $$\int_\Gamma [m_V d/\rho_V + m_A d/\rho_A + (u - u_F)d - 2(1 - x_C)v_G l_G]\, ds = 0,$$

where s denotes arc length along the gap segment Γ. Together with the heat conduction solution previously discussed, this equation determines the vertical velocity u of the metal surface at step 210. With $u_F$ available from step 208, and u available from step 210, $l_G$ can be updated 212 at the current time step using $$\frac{dl_G}{dt} = u_F - u$$

and the method may return 213 to step 208.

Values determined for the bubble flux m, the speeds $u_F$ and u, and the gap width $l_G$, and optionally values of other calculated quantities, may be output 214. Once values for the bubble flux m, gap width $l_G$, and liquid metal flow speed or mold filling speed u have been determined, these values are checked to see if they lie within appropriate ranges 216 and 218. If not, one or more parameter values may be changed 220 and 222 and the method re-executed.

In gap mode the mold filling speed u is usually less than 1 cm/s, but in some cases the filling speed can be negative for a short period of time as the metal temporarily retreats in order to accommodate a large quantity of bubble flux into the gap. Typical values for bubble flux range from 0–10 g/m-s.

Figure 4:
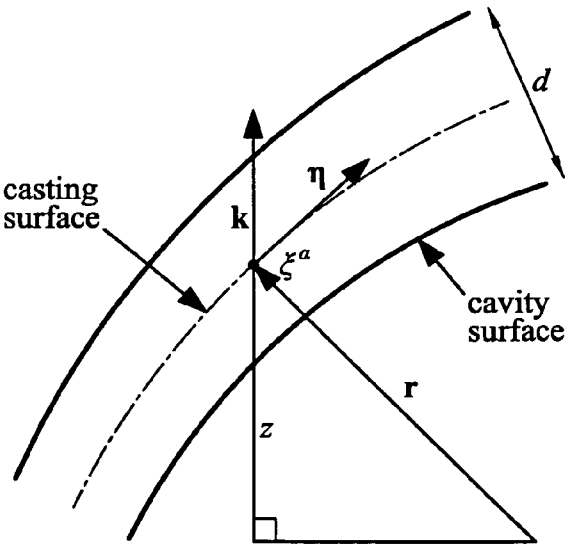
FIG. 4 shows a cross section of a casting surface for bubble flux analysis.

The discussion now turns to the equations governing the motion of the vapor bubbles through the liquid metal, and evaluation of the mass flux $m_V$. FIG. 4 shows a section through a region of the mold cavity occupied by liquid metal. For purposes of this disclosure, the casting may be idealized as a shell-like region represented by a two-dimensional surface in space, called the casting surface, together with an associated thickness that may vary from point to point. The two coordinates $\xi^\alpha(\alpha=1, 2)$ define curvilinear coordinates on the idealized casting surface and $r(\xi^\alpha)$ denotes the position vector to any point $\xi^\alpha$ on that surface from some chosen origin. It is assumed herein that the bubbles rise along a direction parallel to the projection of the vertical unit vector k on the local tangent plane of the casting surface r. Let z denote the vertical distance from the origin, so that r·k=z. Then, with a comma before a subscript denoting differentiation with respect to a curvilinear coordinate, $$r_{,\alpha} \cdot k = a_\alpha \cdot k = z_{,\alpha},$$

where $a_\alpha$ are the covariant base vectors on the casting surface corresponding to the coordinates $\xi^\alpha$. Since the base vectors are tangent to the surface, it follows that the bubbles rise parallel to the unit vector $$\eta(\xi^\alpha) = \frac{z_{,\alpha} a^\alpha}{(a^{\beta\gamma} Z_{,\beta} Z_{,\gamma})^{1/2}},$$

where $a^\alpha$ are the contravariant base vectors and $\alpha^{\alpha\beta}$ are the contravariant components of the surface metric tensor. Note that the unit vector η is not defined at points where the surface is locally horizontal.

Below, $m(\xi^\alpha)$ denotes the local mass flux vector of bubbles per unit length along the casting surface. It is also called the bubble flux vector. According to the above assumptions, m is directed parallel to η, with $$m = m(\xi^\alpha)\eta.$$

The scalar function $m(\xi^\alpha)$ is called the bubble flux. At points where the tangent plane is horizontal, it is reasonable to expect the bubble flux vector to vanish, and so here m is set to 0 to avoid the ambiguity of an undefined η. Before formulating an equation governing the bubble flux m, the possible diffusion of gas from the bubbles through exposed areas of the coating between the globules of excess liquid as they ascend is discussed.

After the bubbles nucleate, they should stay fairly close to the coating as they rise since bubbles that touch the coating share less surface area with the liquid metal and hence require less surface energy per unit volume of gas. When the bubbles encounter exposed areas of coating as they rise, though, some of their gas can diffuse through the coating and into the surrounding sand, subtracting from the local bubble flux. Let $m_C(\xi^\alpha)$ denote the mass flux of gas per unit area diffusing through the coating from the bubble stream at the point $\xi^\alpha$. It may be expected that $m_C$ increases with the local bubble density and the metal pressure.

It is assumed that in general $m_C$ is specified by a constitutive equation $$m_C = \kappa_B v_G m,$$

where $v_G$ is the filter velocity of the gas diffusing through the coating (discussed above) and the coefficient $\kappa_B$, called the bubble diffusion coefficient, is a constant.

Considering the vaporization of additional gas from the excess liquid and the bubble diffusion flux defined by the constitutive equation above, the overall balance of mass for the gas bubbles in the liquid metal may be expressed by the bubble flux equation $$2x_C\gamma-2(1-x_C)\kappa_B v_G m=\nabla\cdot(m\eta),$$

where $\nabla=a^{\alpha}\partial/\partial\xi^{\alpha}$ is the divergence operator on the casting surface. The first term is the rate of vapor creation, the second represents the rate of gas diffusion through the coating, and the last represents the rate of change of the local vapor mass. When the bubbles break through the flow front, the mass flux of gas entering the corresponding gap segment is given by $$m_V=m/d.$$

For a general mold cavity, the bubble flux equation must be solved numerically, for instance by using a finite element approach, to be discussed next.

The casting surface may be represented by a mesh of triangular finite elements. Within each element, the unit vector $\eta$ is a known constant, as defined above. The scalar unknown m varies from node to node. When the denominator in the expression defining $\eta$, i.e., $(\alpha^{\beta\gamma}z_{,\beta}z_{,\gamma})^{1/2}$, is sufficiently small, the bubble direction vector is undefined and the bubble flux in that element is assumed to be zero. The active finite element mesh at any given time consists of all nodes that have "filled" with liquid metal, together with all their adjoining elements.

In one embodiment of a finite element analysis for solving the bubble flux equation, a least squares satisfaction of the mass balance equation integrated over each element may be used. The bubble flux through the liquid metal is governed by the bubble flux equation. Since the bubble direction vector $\eta$ is constant in each triangular finite element on the cavity mid-surface, the bubble flux equation reduces to $$2x_C\gamma-2(1-x_C)\kappa_B v_G m=\nabla\cdot(m\eta)=\eta\cdot\nabla m$$

inside the boundaries of a single element. If the bubble flux m is specified by linear shape functions $\xi_i$ within the element, then $$M=\sum_{i=1}^{3}\xi_i m_i,$$

where $m_i$ are the values of the bubble flux at the nodes. It follows that $$\eta\cdot\nabla m=\sum_{i=1}^{3}(\eta\cdot\nabla\xi_i)m_i.$$

Now since the gradients $\nabla\xi_i$ are constant in a given element, the coefficients of $m_i$ in the last equation are also constant over the element. The bubble flux equation can be integrated over a single element to yield the integrated equation $$\sum_{i=1}^{3}\left[\eta\cdot\nabla\xi_i+\frac{2}{3}(1-x_C)\kappa_B v_G\right]m_i=2x_C\gamma.$$

This equation is linear in the unknown bubble flux values $m_i$ at each node, with a right-hand side that depends on the average rate of vaporization in the element. Since there are always more elements than nodes, the integrated bubble flux equation may be satisfied in a least-squared sense over the entire metal region, as follows.

Define the quantities $$S_i^e=\eta\cdot\nabla\xi_i+\frac{2}{3}(1-x_C)\kappa_B v_G,$$

$$b^e=\frac{2}{3}x_C\sum_{i=1}^{3}\gamma_i,$$

where the superscript e designates a value for a particular finite element. With these definitions, the entire array of equations represented by the integrated bubble flux equation may be simplified to $$\sum_{i=1}^{3}S_i^e m_i=b^e\ (e=1,2,\ldots E),$$

where E denotes the total number of active elements in the metal region. To find the least-squared solution of this over-determined system, both sides may be multiplied by $S_j^e$ and summed over e to obtain the system of N equations $$\sum_{i=1}^{N}\left(\sum_{e=1}^{E}S_j^e S_i^e\right)m_i=\sum_{e=1}^{E}S_j^e b^e\ (j=1,2,\ldots,N),$$

where N denotes the total number of nodes. This is a positive definite, symmetric system of equations for the nodal values of the bubble flux.

When $x_C=1$ (as in contact mode), the solution of the bubble flux equation is determined only to within an arbitrary constant. To make the solution unique, m may be set to 0 at every active node in the metal region that cannot be "fed from below" by vaporizing liquid. Such a node has no potential source for any bubble flux, regardless of the distribution of the excess polymer liquid. A node is considered "fed from below" if in one of its active adjacent elements the bubble flux vector points out of the element ($n\cdot\eta>0$) along both of the two element edges that intersect at this node.

The method, system and apparatus utilizing the method and system as described herein may have a number of different modules for different modes occurring during the lost foam casting process. The modules may work in series or parallel, analyzing the conditions, making predictions for the process of lost foam casting and providing for the adjustment of parameters either manually or automatically to improve results.

As shown in FIG. 5, an embodiment of a system 500 may include a process control interface 502 and the processor unit 504 may also send output data to a process control unit including a storage device 506 so that active control of the lost foam casting process may take place through communication unit WAN 508 via modem/network connection 509. Network connection 509 may also provide connection through communication unit LAN 510.

A memory unit 524 is provided for storage of software modules implementing the algorithms. The processor unit executes the instructions of the software modules 512, 514, up to 516, which may be stored in memory module 524. The processor unit is connected to each of the user interface items, as well as to the process control interface, if present, and to the modem and/or network connection unit. In addition, connection is provided for a printer or plotter device 526, and for external storage. The process control unit including a storage device may include, besides a process control unit, a floppy drive, CD drive, external hard disk, or magneto-optical or other type of drive.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

The invention claimed is:

1. A method for analyzing foam decomposition in gap mode during mold filling in lost foam casting, the casting process characterized by a bubble flux and a gap width, and the mold filling having a mold filling speed, the method comprising:

providing a plurality of parameter values for casting process parameters as variables in a plurality of predetermined equations;

simultaneously solving the plurality of predetermined equations including the parameter values;

calculating a flux value for the bubble flux, a gap value for the gap width, and a speed value for the mold filling speed; and determining whether to adjust at least one of the parameter values based on an analysis of the flux value, the gap value, and the speed value.

2. A method as recited in claim 1, wherein one of the plurality of parameter values is a casting metal pressure.

3. A method as recited in claim 1, wherein one of the plurality of parameter values is a foam property.

4. A method as recited in claim 1, wherein one of the plurality of parameter values is a coating property.

5. A method as recited in claim 1, wherein one of the plurality of parameter values is a sand property.

6. A method as recited in claim 1, wherein calculating a bubble flux comprises solving a bubble flux equation using a finite element approach.

7. A method as recited in claim 1, wherein the flux value has a predetermined range and wherein determining whether to adjust values of one or more of the casting process parameters comprises:

checking whether the flux value lies in the predetermined range.

8. A method as recited in claim 1, wherein the speed value has a predetermined range and wherein determining whether to adjust values of one or more of the casting process parameters comprises:

checking whether the speed value lies in the predetermined range.

9. A method as recited in claim 1, further comprising:

generating adjustment data;

sending the adjustment data to a process control unit for active control of a casting process.

10. A system for analyzing foam decomposition in gap mode during mold filling in lost foam casting, the casting process characterized by a bubble flux and a gap width, and the mold filling having a mold filling speed, the system comprising:

an equation module for providing a plurality of parameter values for casting process parameters as variables in a plurality of predetermined equations;

a solution module for simultaneously solving the plurality of predetermined equations including the parameter values;

a calculation module for calculating a flux value for the bubble flux, a gap value for the gap width, and a speed value for the mold filling speed; and an adjustment module for determining whether to adjust at least one of the parameter values based on an analysis of the flux value, the gap value, and the speed value.

11. A system as recited in claim 10, wherein the plurality of parameter values comprises a casting metal property, a foam property, a coating property, and a sand property.

12. A system as recited in claim 10, wherein the flux value has a predetermined range, the gap value has a predetermined range, and wherein the speed value has a predetermined range and wherein the adjustment module comprises:

a first checking module for checking whether the flux value lies in the predetermined range;

a second checking module for checking whether the speed value lies in the predetermined range: and a third checking module for checking whether the gap value lies in the predetermined range.

13. A system as recited in claim 10, wherein calculating a flux value for the bubble flux comprises solving a bubble flux equation using a finite element approach.

14. An apparatus for analyzing foam decomposition and mold filling in a lost foam casting process in gap mode, the casting process characterized by a bubble flux and a gap width, and the mold filling having a mold filling speed, the system comprising:

a memory unit;

a parameter instruction unit including parameter instructions for retrieving a plurality of process parameter values from the memory unit;

a solution instruction unit including solution instructions for simultaneously solving a plurality of equations having process parameter values;

a calculating instruction unit including calculation instructions for calculating a value for the bubble flux, a value for the gap width, and a value for the mold filling speed;

a processor for receiving parameter instructions, solution instructions and calculation instructions and for generating values for the bubble flux, the gap width, and the mold filling speed; and an adjustment instruction unit including adjustment instructions for determining whether to adjust values of one or more of the process parameter values according to the bubble flux, the gap width, and the mold filling speed.

15. An apparatus as recited in claim 14, wherein one of the plurality of process parameter values is a casting metal pressure.

16. An apparatus as recited in claim 14, wherein one of the plurality of process parameter values is a foam property.

17. An apparatus as recited in claim 14, wherein one of the plurality of process parameter values is a coating property.

18. An apparatus as recited in claim 14, wherein one of the plurality of process parameter values is a sand property.

19. An apparatus as recited in claim 14, wherein calculating a value for the bubble flux comprises solving a bubble flux equation using a finite element approach.

20. An apparatus as recited in claim 14, wherein the bubble flux has a predetermined range, the gap width has a predetermined range, and the mold filling speed has a predetermined range and the adjustment instructions further include instructions for determining whether to adjust values of one or more of the process parameter values, comprising:

a first checking unit including instructions for checking whether the vapor value lies in the predetermined range;

a second checking unit including instructions for checking whether the speed value lies in the predetermined range: and a third checking unit including instructions for checking whether the gap value lies in the predetermined range.

* * * * *